US011511147B2

(12) United States Patent
Lilly

(10) Patent No.: US 11,511,147 B2
(45) Date of Patent: Nov. 29, 2022

(54) WORKOUT STATION

(71) Applicant: Kathline Lilly, Los Angeles, CA (US)

(72) Inventor: Kathline Lilly, Los Angeles, CA (US)

( * ) Notice: Subject to any disclaimer, the term of this patent is extended or adjusted under 35 U.S.C. 154(b) by 0 days.

(21) Appl. No.: 16/798,192

(22) Filed: Feb. 21, 2020

(65) Prior Publication Data

US 2020/0269078 A1 Aug. 27, 2020

Related U.S. Application Data

(60) Provisional application No. 62/808,661, filed on Feb. 21, 2019.

(51) Int. Cl.

| | |
|---|---|
| ***A63B 17/00*** | (2006.01) |
| ***A63B 6/00*** | (2006.01) |
| *A63B 26/00* | (2006.01) |
| *A63B 21/055* | (2006.01) |

(52) U.S. Cl.

CPC ..... *A63B 17/00* (2013.01); *A63B 6/00* (2013.01); *A63B 21/0552* (2013.01); *A63B 26/00* (2013.01)

(58) Field of Classification Search

CPC ..... A63B 2071/027; A63B 17/00; A63B 21/0552; A63B 26/00; A63B 21/4029; A63B 2225/687; A63B 2225/10; A63B 21/16; A63B 6/00–02; A63B 22/203

See application file for complete search history.

(56) References Cited

U.S. PATENT DOCUMENTS

| | | | | |
|---|---|---|---|---|
| 4,863,163 | A * | 9/1989 | Wehrell | A63B 21/04 482/129 |
| 5,320,591 | A * | 6/1994 | Harmon | A63B 23/00 482/121 |
| 5,407,404 | A * | 4/1995 | Killian | A63B 21/0552 482/123 |
| 6,053,340 | A * | 4/2000 | Cameron | A47B 97/04 211/85.7 |
| 6,357,616 | B1 * | 3/2002 | Harris | A63B 22/02 220/555 |
| 7,488,277 | B1 * | 2/2009 | Knapp | A63B 21/0626 482/106 |
| 7,938,763 | B2 | 5/2011 | Campanaro et al. | |
| 8,491,449 | B2 * | 7/2013 | Rogers | A63B 21/0628 482/100 |
| 10,232,213 | B1 * | 3/2019 | Smith, Jr. | A63B 23/1281 |
| 10,806,963 | B2 * | 10/2020 | Staten | A63B 23/1218 |
| 2005/0059536 | A1 * | 3/2005 | Croft | A63B 1/00 482/123 |
| 2006/0122044 | A1 * | 6/2006 | Ho | A63B 21/0552 482/129 |
| 2007/0155597 | A1 * | 7/2007 | Hockemeyer | A63B 21/0783 482/99 |
| 2009/0069161 | A1 * | 3/2009 | Caldwell | A63B 23/12 482/138 |
| 2009/0098987 | A1 * | 4/2009 | McBride | A63B 21/055 482/133 |

(Continued)

FOREIGN PATENT DOCUMENTS

WO 2020172625 A1 8/2020

*Primary Examiner* — Jennifer Robertson
*Assistant Examiner* — Catrina A Letterman
(74) *Attorney, Agent, or Firm* — Buchalter; Cecily Anne O'Regan

(57) ABSTRACT

Exemplary embodiments of a workout station and methods of using the workout station are provided.

7 Claims, 6 Drawing Sheets

(56) References Cited

U.S. PATENT DOCUMENTS

| | | | | |
|---|---|---|---|---|
| 2011/0092348 | A1 | 4/2011 | Mcbride et al. | |
| 2015/0031514 | A1* | 1/2015 | Deis | A63B 17/00 482/142 |
| 2015/0191918 | A1* | 7/2015 | Atkinson | E04F 15/02172 52/177 |
| 2015/0202483 | A1* | 7/2015 | Ho | A63B 21/4035 482/122 |
| 2017/0128775 | A1* | 5/2017 | Santos | A63B 21/00069 |
| 2017/0266503 | A1 | 9/2017 | Watterson et al. | |
| 2020/0172625 | A1 | 6/2020 | Coyle et al. | |
| 2020/0246653 | A1 | 8/2020 | Merrithew et al. | |

* cited by examiner

WORKOUT STATION

PRIORITY

This application claims priority to U.S. Provisional Patent Application No. 62/808,661, filed Feb. 21, 2019, titled Workout Station, which is incorporated by reference in its entirety herein.

BACKGROUND

There are different designs for exercise and weight training equipment. The conventional weight training component is free weights and a bench to sit or lay on. Weight machines are also provided in which weights or resistance is provided in a controlled manner such as with levers to be pulled or pushed.

SUMMARY

Exemplary embodiments of a workout station provided herein include a platform configured and designed to use with different exercise techniques and programs.

Exemplary embodiments of a workout station provided herein include a support structure including a plurality of cross beams. The beams may be vertical, horizontal, angled, and combinations thereof. The support structure may include an area for supporting a seat. In an exemplary embodiment, the seat is configured to have a stored configuration and a use configuration. The stored configuration may position the seat out of the way to provide access to a portion of the support structure and/or provide additional space proximate to the support structure.

Exemplary embodiments of a workout station provided herein includes one or more attachment(s) of and/or for resistance components. The exemplary attachments may be on one or more portions of the support structure, such as one or more of the plurality of cross beams.

Exemplary embodiments described herein include workouts and routines for physical exercise. Exemplary embodiments of the workout process may or may not include the workout station described herein.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Figure 1:
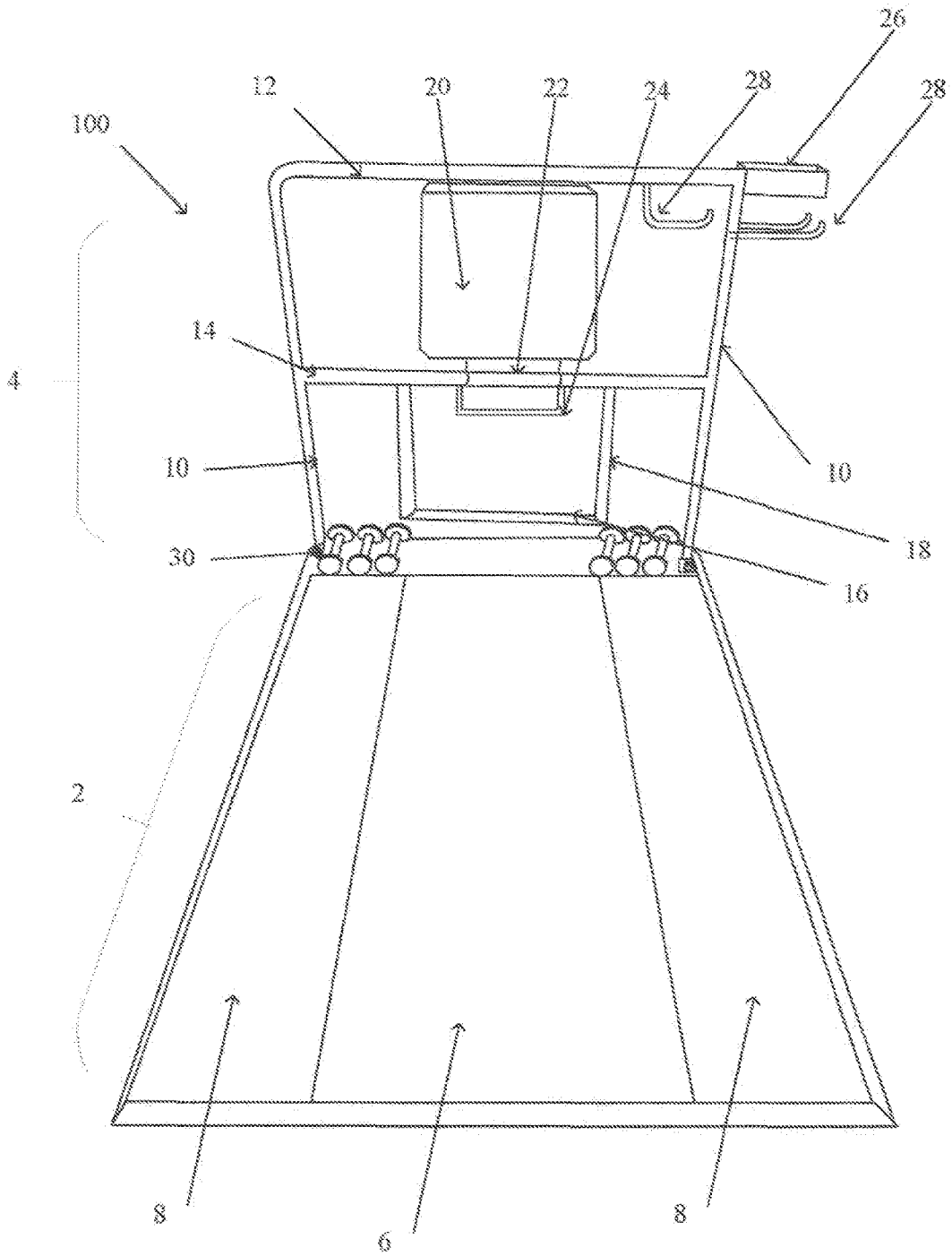
FIGS. 1-2 illustrate exemplary embodiments of a workout station having a platform, support structure, and user support, where the user support is in a stored configuration and in use configuration, respectively.
Figure 2:
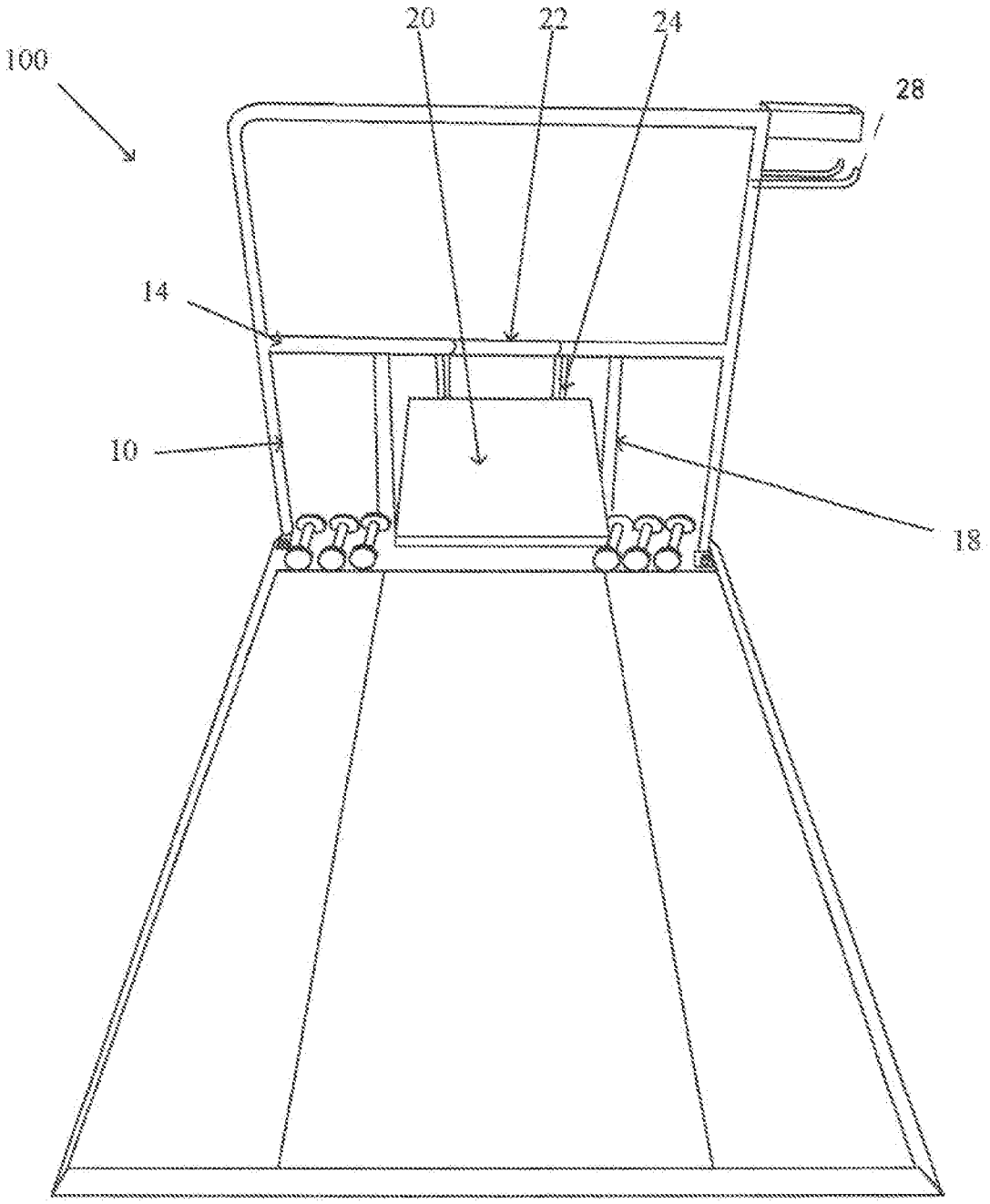

FIG. 1 illustrates an exemplary embodiment of a workout station 100 according to embodiments described herein. FIG. 2 illustrates the exemplary workout station 100 of FIG. 1 in which the seat is in an open configuration. Exemplary embodiments of the workout station includes a platform 2 and support structure 4. The platform 2 may be used for performing floor exercises. The support structure may support a user, such as by use of a seat supporting the weight of a user or a cross beam assisting with balance of a user; and/or may support exercise equipment, such as weights, resistance components, and combinations thereof.

FIGS. 1-2 illustrate an exemplary workout station 100 having a platform 2. As shown, the platform 2 may have a generally level and/or planar surface. The platform may be configured for performing floor exercises. In an exemplary embodiment, the platform may include a surface of increased frictional engagement, a padded surface, a low frictional surface, and combinations thereof. In an exemplary embodiment, the platform 2 may include one or more portions, such as first and third portion 8 and second portion 6. The different portions of the platform may have the same and/or different attributes, such as increased or decreased frictional engagement, texture or roughened surface, padding, rigidity, etc. As shown, the platform may include three portions, a first and third portion 8 may have similar physical attributes, such as the same material construction, frictional engagement, surface texture, rigidity, etc. The second portion 6 may have different physical attributes, such as being of a different material construction, frictional engagement, surface texture, flexibility, etc. as compared to either the first or third portions 8. As shown, the second portion 6 may be padded and therefore more flexible or compressible than the first and/or third portions 8. As shown, the second portion 6 may provide a greater frictional engagement to reduce slipping along the surface of the second portion 6 as compared to the first and/or third portions 8. As shown, the first and third portions 8 may have a lower frictional surface, such that the surface is configured for a user to slide along the surface, such as with a sock or bootie.

The platform 2 may include a padding or other compressible material positioned under the respective surfaces and/or may be integrated into the surfaces. The padding may provide impact resistance and/or permit prolonged support for a user positioned on the platform.

Figure 4:
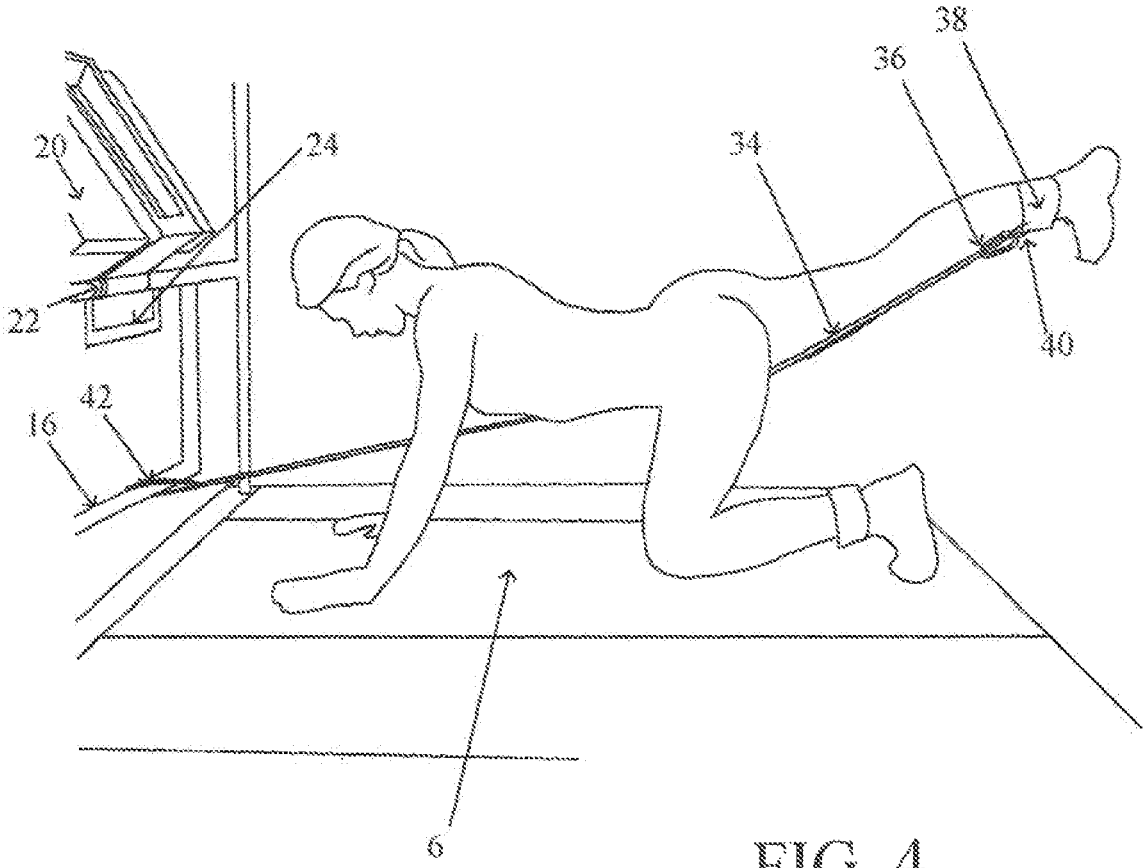
FIGS. 4-6 illustrate exemplary uses and exercises to be performing using exemplary embodiments of the workout station described herein.

FIGS. 1-2 illustrate a workout station 100 having a support structure 4. As shown, the support structure 4 is positioned at one end of the platform 2. The support structure is configured to support a user, such as in balancing, stretching, and/or sitting. The support structure 4 is configured to provide a user support 20, such as a seat. The support structure is configured to support and/or attach exercise equipment, such as weights 30, resistance components 32, etc. As shown in FIGS. 1 and 4, the user support 20 is in a stored position where the user support 20 does not extend over the horizontal platform and is positioned perpendicular to the horizontal platform. As shown in FIG. 2, the user support 20 is in a use position where the user support 20 is rotated into a position over the horizontal platform so that the user support 20 is parallel to the surface of the horizontal platform.

In an exemplary embodiment, the support structure 4 includes a plurality of beams 10, 12, 14, 16, 18, 24. The beams 10, 12, 14, 16, 18, 24 are arranged in vertical, horizontal, or angled orientations relative to each other to define the support structure 4. The plurality of beams may be supported or attached to the platform to keep the support structure from moving during use and/or to orient the support structure during use. The plurality of beams may be supported by a base such as flat or cross beams to keep the support structure from moving during use and/or to orient the support structure during use.

In an exemplary embodiment illustrated in FIGS. 1-2, the plurality of beams 10, 12, 14, 16, 18, 24 are arranged in a plane. The arrangement permits an efficient and compact use of space. The plurality of beams 10, 12, 14, 16, 18, 24 includes two pairs of vertical support bars 10, 18 and two cross bars 12, 16. The two pairs of vertical support bars include an outer pair 10 and an inner pair 18. As shown, the outer pair 10 is longer and therefore rise higher in a use configuration than the inner pair 18. The two cross bars 12, 14 are arranged horizontally. A first cross bar 14 is at a terminal end of the inner pair of vertical support bars 18 and a second cross bar 12 is at a terminal end of the outer pair of vertical support bars 10. The first cross bar attached to each of the first pair of vertical support bars, such as at a terminal end of the inner pair of vertical support bars and at a middle region of the outer pair of vertical support bars. The second cross bar attaches to the outer pair of vertical support bars, such as at a terminal end of the outer pair of vertical support bars.

In the exemplary embodiment illustrated in FIGS. 1-2, additional beams may be provided in the plurality of beams of the support structure. For example, the inner pair of vertical support bars 18 may be supported and attached at terminal ends thereof to the first cross bar 14. The inner pair of vertical support bars 18 may support and attach to additional bars, such as third cross bar 16 on the opposing ends or in a middle section of the inner pair of vertical support bars. As illustrated, the inner pair of vertical support bars extend below the first cross bar toward the floor, but are less than a length of the outer vertical support bars 10 extending from the first cross bar 14 toward the floor, such that the inner pair of vertical support bars 16 terminate toward the floor before (or further away from the floor) than the outer pair of vertical support bars. Additional bars 24 may also be provided herein. For example, similar to the inner pair of vertical support bars 18 supporting third cross bar 16, another pair of inner vertical bars may support another cross bar. The another pair of inner vertical bars and another cross bar may be supported on the first and/or second cross bar (illustrated from the first cross bar).

The support structure may also include other features for supporting a user or other objects. For example, one or more protruding bars 28 may be used to support weights, resistance components, towels, shoes, etc. As illustrated, the protruding bar 28 may be positioned on an exterior side of the support structure 4 and extend outward or inward. The protruding bar 28 may also extend from one or more cross bars within the support structure. As seen in FIG. 1, the protruding bar 28 may extend outward from a downward extension off of a cross bar of the support structure as described herein. The protruding bars 28 may occur in pairs, or may be configured or shaped to support a desired object. For example, the protruding bar may be generally flat and/or may include two projections of approximately the same height to support one or more weights. The protruding bar may include a hook or upward curved end to support a towel or retain a weight positioned thereon. Other support features may also be included. For example, a support container 26 may be provided. The container 26 may include a bottom and/or may include an open bottom, and/or a side wall. The bottom and/or sidewall combination may be used to hold or retain items of the user, such as a cell phone, music player, water bottle, keys, or other items. One or more support containers may be provided on the support structure.

The support structure 100 may be configured with a user support 20. As shown, a seat is incorporated and supported by the support structure. As seen by the comparison between FIGS. 1 and 2, the user support 20 may be configured to be in a first stored configuration and a second use configuration. The first stored configuration orients the seat relative to the support structure to provide access to the support structure by a user and/or open space adjacent or proximate the support structure. In an exemplary embodiment, the stored configuration permits additional space for use by a user of the platform, by reducing the profile of the chair positioned over the platform. In an exemplary embodiment, the user support 20 is coupled to one or more bars (such as bar 14) of the support structure 4 through a rotation engagement 22. The user support 20 may be rotated between the first stored configuration and the second use configuration. In an exemplary embodiment, the seat is pivotably coupled to the first cross bar. The support structure may include a stop to prevent further rotation of the seat in a given direction. The stop may be positioned such that when the stop is engaged by contact with the seat, the seat is oriented in the second use configuration and is positioned generally horizontal or parallel to the platform. As shown, the stop includes a projection in the plane of the support structure and oriented below the first cross bar. The stop may create an aperture and/or attachment for other exercise equipment as described herein. As illustrated, the stop may comprise a plurality of bars similar to vertical bars and cross bars described herein. The stop may also be a sheet or solid extension to contact and support a portion of the seat.

FIG. 4 illustrates a side perspective view of the user support 20, rotational engagement 22 and stop 24. As illustrated, the user support 20 includes holder that is generally perpendicular to form a portion that is positioned under the seat and a portion that extends from the cross bar of the support structure perpendicular to the portion that extends under the seat. The rotational engagement 22 permits the seat to be rotated and extend generally upward or extend generally outward over the platform. The portion of the holder extending from the support structure may contact the stop 24 and prevent further rotation in one direction such that the seat is positioned for an in use orientation to be used to support a user.

As shown herein, the exemplary user support comprising a seat may be made of a padded material and/or rigid support material. The seat may be generally shaped as a square to be used similar to a chair. The seat is not so limited and can be any combination of shapes and/or sizes. For example, the seat may extend across all or a larger portion of the support structure to create a rectangular or elongated seat, similar to a bench. The seat may also or alternatively be extended further outward from the support structure. The seat may also include extendable, rotatable, and/or attachable legs to provide additional support in the use configuration.

Figure 3:
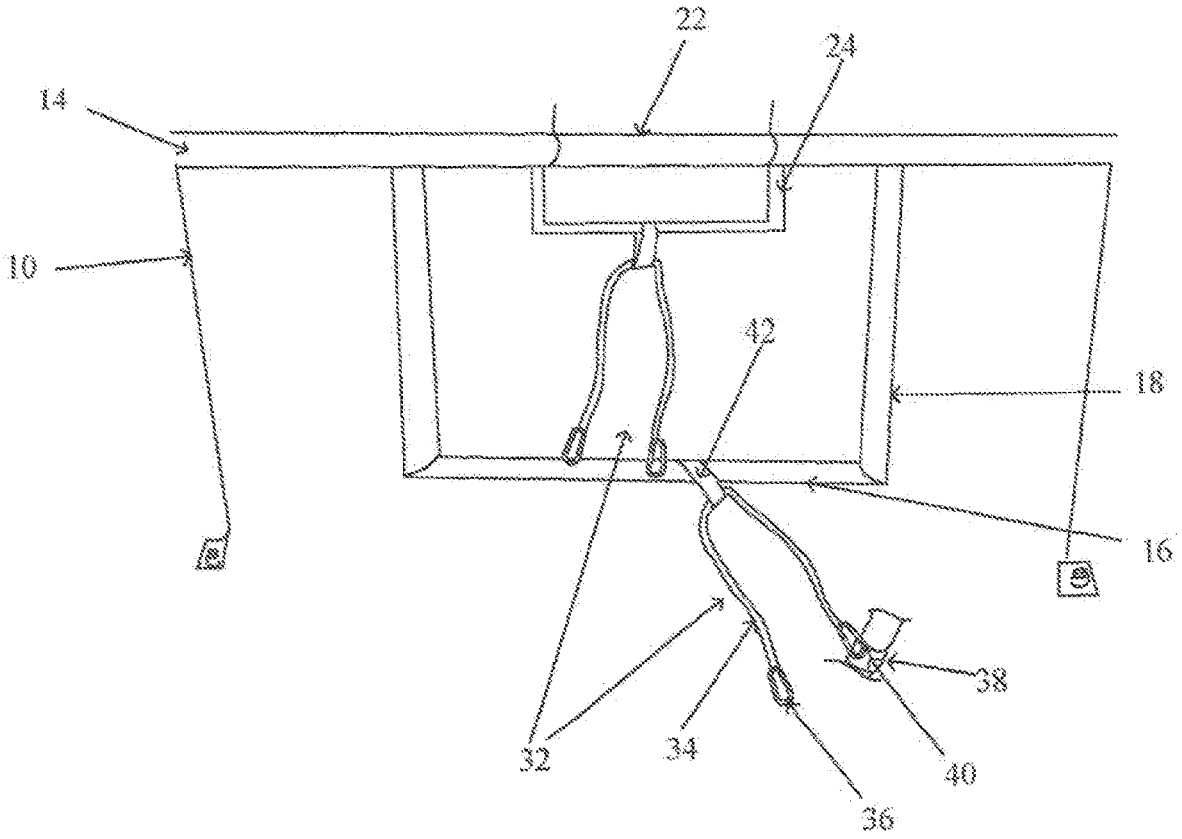
FIG. 3 illustrates a portion of the exemplary workout station of FIG. 1 including resistance components.

In an exemplary embodiment, the support structure comprises bars. The bars may be of any cross dimensional shape. In an exemplary embodiment, the bar may be sized to permit attachment of other exercise equipment. FIG. 3 illustrates a portion of the support structure 4 illustrated in FIG. 1 having resistance components attached thereto. As shown, resistance components 32 may be attached to one or more bars 10, 12, 14, 16, 18, 24 of the support structure (including the stop and/or seat described herein). The resistance components may be attached by tying, looping, hook, button, snap, or other method. An exemplary attachment feature 42 may be used to couple the resistance component to the support structure. The resistance component may also attach by being wrapped directly around a portion of the support structure. As illustrated, the attachment feature 42 may be a strap that couples to itself to secure the resistance components 32, strap 34, to the support structure 4.

In an exemplary embodiment, the resistance component is a resistance band. The band may be a generally flat or tubular, elongated, resiliently flexible, and/or stretchable component. As seen in FIG. 3, the terminal ends of the resistance component may have an attachment feature for securing to a user. The attachment feature described herein may be used for attaching the resistance components to either of the user and/or the support structure. The attachment feature(s) may be the same and/or may be different depending on the attachment. The attachment feature may include a releasable attachment device 40 and a securing device 38. As illustrated herein, the securing device 38 may be a band that attaches to itself and configured to position around a body part of the user. The securing device may be padded on an interior side thereof to provide a comfortable interface to a user. The securing device 38 may include snaps, buckle, hook and loop fastener, ratchet, rivet, or other method of removable attachment for the securing device 38 to attach to itself. The attachment feature may also include a releasable attachment that may removably attach to the securing device. The releasable attachment 36 may be a hook, spring, button, buckle, hook and loop fastener, or other method of removable attachment. As illustrated, the securing device may have a mated feature 40 to interface with the releasable attachment 36. As illustrated, the mated feature is a loop, but may be other feature to engage and removably coupled to the releasable attachment.

The resistance components are configured to couple between the support structure and a user to provide resistance to a user as the user pulls or pushes the resistance component away from the support structure. The resistance components may be configured to attach to any portion of the support structure. The resistance components may removably attach to the support structure and/or the user to permit easy transitions between exercises using the workout station according to embodiments described herein.

FIG. 3 illustrates an exemplary attachment of resistance components to embodiments of the support structure. As shown, the resistance components may include elongated bands of either planar and/or cylindrical shape. The support structure may include loops encircling one or more bars of the support structure. The loops may provide sufficient space between the loop and the bar that the resistance component may be attached, such as being threaded through the aperture of the loop. The resistance components may include attachment feature at terminal ends of the resistance components. The attachment feature may be configured to couple to the workout station and/or the user.

FIG. 4 illustrates an exemplary embodiment of the resistance component attached to a user. As shown, the resistance component may include a system having a securing device configured to attach to a user. The securing device illustrated is a band configured to encircle and removably attach to a limb of the user. The band may be a hook and loop fastened (or other attachment method such as buttons, snaps, etc.) band configured to encircle a limb of the user. The band may also be elastic and/or otherwise removably attach to a user. The securing device may be configured to removably attach to the resistance component. As illustrated, the terminal end of the resistance component includes an attachment feature configured to couple to the securing device coupled to the user. The attachment feature may include hook and loop, such that a hook is provided as one attachment feature and a loop is provided as the corresponding mated feature.

FIG. 4 illustrates an exemplary exercise for use with embodiments described herein. As illustrated, the user may kneel with hands and knees on the padded portion of the device for comfort and frictional retention. The user may couple the elastic band to the ankle attachment at one end and to the device structure at an opposite end. The elastic band may also be positioned through an attachment feature coupled to the support structure and both terminal ends of the elastic band coupled to the user. The user may extend a leg away from the support structure (or attachment portions of the elastic band), thereby imposing a pulling force against the extended leg. The extensions may be performed in repetition to generate sets of leg extensions in which the leg is straightened out generally horizontal and in line with the head and spine of the user, and returned to a bent position generally perpendicular to the user's spine and head and under the user's pelvis.

Figure 5:
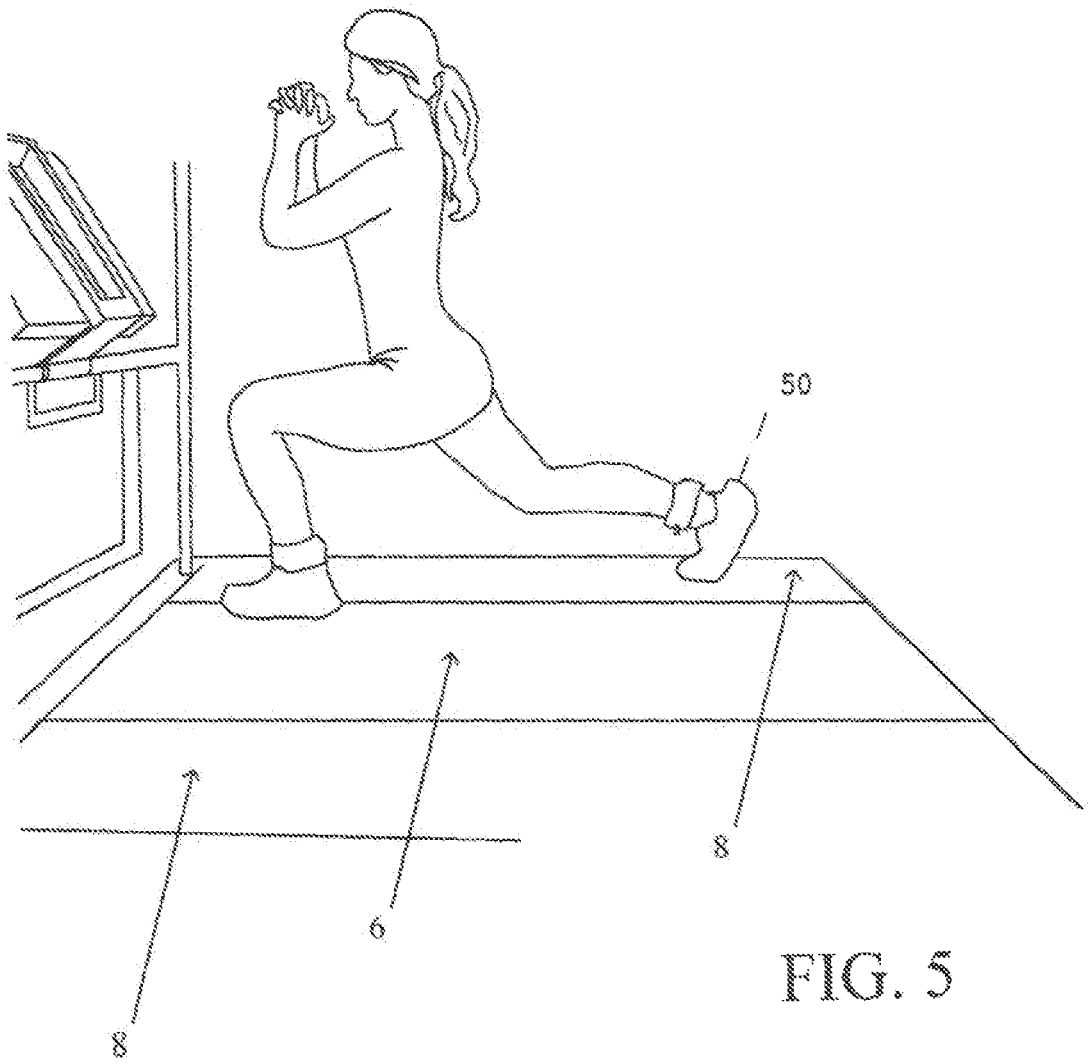

FIG. 5 illustrates an exemplary exercise for use with embodiments described herein. As illustrated, the user may include a bootie 50 on one foot for creating a less frictional engagement between the user's foot and a portion of the device. The bootie may be a shoe like configuration that is placed on the user's foot instead of a shoe. The bootie may also be a covering that is positioned over the user's shoe that reduces the frictional engagement created by the sole of the shoe by providing an alternative surface to contact the platform surface. For example, a bootie may be a material with an elastic perimeter that may be removably positioned as a cover over a user's shoe. The user's other foot may be shoed to create a greater frictional engagement with another portion of the station. For example, an interior portion of the station may include a more frictional and/or cushioned pad, while an exterior and/or lateral side of the station includes a less frictional and/or cushioned panel. The user may position the shoed foot in a desired forward position on the frictional pad and position the bootied foot on the less frictional surface. The user may step backward and/or slide the bootied foot backward along the less frictional surface such that the user moves from a generally standing position to a generally lunging position. The front leg is positioned such that the knee is over the foot and the leg is in a generally perpendicular relationship. The back leg may be slid backward and generally extended behind the user. The user may then push against the front leg and slide the back leg forward to return to a generally standing position.

Figure 6:
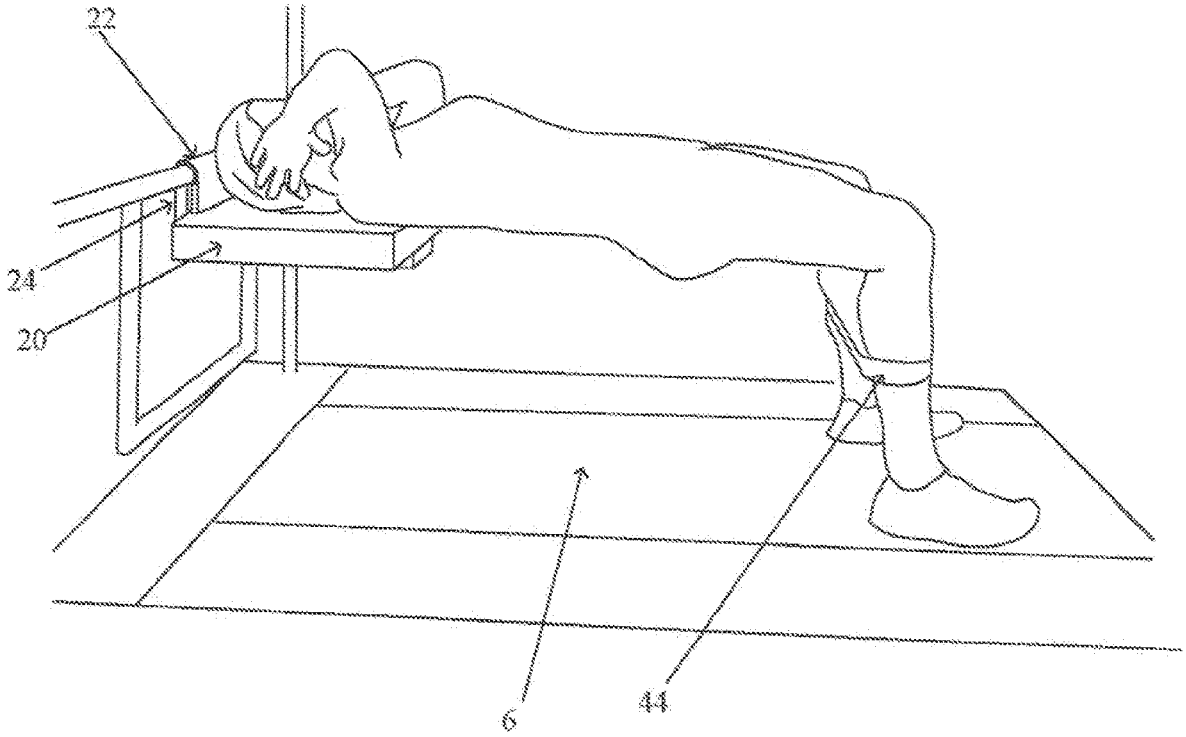

FIG. 6 illustrates an exemplary exercise for use with embodiments described herein. As illustrated, the user may rest an upper body portion on a bench or projection of the station and position the user's feet on the frictional surface and/or padded surface of the station. The feet may be positioned away from the bench/projection such that a user's torso and upper body is generally horizontal to the floor. The user's legs may be bent at approximately perpendicular to the body to support the lower portion of the user over the floor. As illustrated, additional resistance components 44 may be used in the exercising using embodiments described herein. In this case, the resistance component is positioned around the user's legs, and not attached to the support structure. The resistance components may be stored on the support structure and removed and positioned on the user's body to facilitate an exercise during an in use of the station described herein.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

As used herein, the terms "about," "substantially," or "approximately" for any numerical values, ranges, shapes, distances, relative relationships, etc. indicate a suitable dimensional tolerance that allows the part or collection of components to function for its intended purpose as described herein. Similarly, other use of relative terms, such as in comparisons are similarly within the scope of the intended purpose and would be understood by a person of skill in the art. For example, the relative frictional surfaces of the platform permit are sufficient frictional or non-frictional to permit the desired exercises. Therefore, the second portion may be of a frictional surface that provides sufficient grip to a user to secure a stance such as in the configuration illustrated in FIG. 6 and/or permits sufficient retention for a user pulling against the resistance components, such as illustrated in FIG. 4. Similarly, the first and third portions of the platform may have lower frictional surfaces that permit sliding, such as to perform the lunge exercises illustrated in FIG. 5. The surface may still permit some frictional retention and remain within the scope of the instant disclosure. For example, the first and third portions may still retain some frictional engagement so that a user may not slip so easily that a pose cannot be safely supported. Numerical ranges may also be provided herein. Unless otherwise indicated, each range is intended to include the endpoints, and any quantity within the provided range. Therefore, a range of 2-4, includes 2, 3, 4, and any subdivision between 2 and 4, such as 2.1, 2.01, and 2.001. The range also encompasses any combination of ranges, such that 2-4 includes 2-3 and 3-4.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A workout station, comprising:

a horizontal platform having a length and a width wherein the horizontal platform has three sections comprising a first portion, a second portion and a third portion, wherein the first portion and the third portion are positioned on opposite sides of the second portion and further wherein the first portion and the third portion have a first material property and the second portion has a second material property different than the first material property wherein first material property and the second material property are selected from frictional engagement, surface texture and rigidity;

a support structure extending vertically in a plane from the horizontal platform at a first end of the horizontal platform wherein the support structure has a first vertical beam at a first side of the horizontal platform and a second vertical beam at a second side of the horizontal platform, a first horizontal beam engaging an upper end of the first vertical beam at a first vertical beam upper end and engaging an upper end of the second vertical beam at a second vertical beam upper end, a second horizontal beam secured along a length of the first vertical beam on a first end and the second vertical beam on a second end;

one or more protruding bars extending planarly from an upper side surface of at least one of the first vertical beam and the second vertical beam;

a third vertical beam and a fourth vertical beam extending from the second horizontal beam towards the horizontal platform wherein the third vertical beam and the fourth vertical beam are positioned within the same plane as the first vertical beam and the second vertical beam, and a third horizontal beam connecting the third vertical beam and the fourth vertical beam at an end opposite a third vertical beam first end connected to the second horizontal beam and the fourth vertical beam first end connected to the second horizontal beam, wherein the third horizontal beam is positioned above the horizontal platform and below the second horizontal beam; and a user support rotationally engaging the second horizontal beam.

2. The workout station of claim 1, wherein the user support has a first position extending over the horizontal platform, and a second position positioned perpendicular to the horizontal platform.

3. The workout station of claim 2, wherein the support structure comprises a stop configured to engage the user support and prevent rotation in one direction such that when the user support abuts the stop, the user support is in the first position.

4. The workout station of claim 1, further comprising a support container.

5. The workout station of claim 1, wherein the second material property of the second portion of the three sections comprises a frictional surface.

6. The workout station of claim 5, wherein the first material property of the first and third portion comprises a lower frictional surface than compared to the frictional surface.

7. The workout station of claim 1, wherein the horizontal platform is padded.

* * * * *